US008435251B2

(12) United States Patent
Sladecek

(10) Patent No.: US 8,435,251 B2
(45) Date of Patent: May 7, 2013

(54) DOCKING STATION FOR A SKIN TREATMENT DEVICE HAVING A COOLING MEMBER

(75) Inventor: Marcel Sladecek, Krumpendorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 101 days.

(21) Appl. No.: 12/933,691

(22) PCT Filed: Mar. 19, 2009

(86) PCT No.: PCT/IB2009/051160

§ 371 (c)(1),
(2), (4) Date: Sep. 21, 2010

(87) PCT Pub. No.: WO2009/118670

PCT Pub. Date: Oct. 1, 2009

(65) Prior Publication Data

US 2011/0015652 A1 Jan. 20, 2011

(30) Foreign Application Priority Data

Mar. 25, 2008 (EP) ..... 08153193

(51) Int. Cl.
*A61B 17/50* (2006.01)

(52) U.S. Cl.
USPC ..... 606/133

(58) Field of Classification Search ..... 606/131, 606/132, 133
See application file for complete search history.

(56) References Cited

U.S. PATENT DOCUMENTS

| | | | | |
|---|---|---|---|---|
| 4,759,191 | A | 7/1988 | Thomas et al. | |
| 5,207,073 | A | 5/1993 | Maier-Laxhuber et al. | |
| 5,359,861 | A | 11/1994 | Maier-Laxhuber et al. | |
| 6,389,839 | B1 | 5/2002 | Sabin | |
| 7,070,488 | B2 * | 7/2006 | Suissa et al. | 451/87 |
| 2002/0120278 | A1 | 8/2002 | Cense et al. | |
| 2005/0080432 | A1 * | 4/2005 | Fertner et al. | 606/133 |
| 2007/0208326 | A1 | 9/2007 | Connors et al. | |

FOREIGN PATENT DOCUMENTS

| | | | |
|---|---|---|---|
| EP | 0348862 | A2 | 1/1990 |
| EP | 0577869 | A1 | 1/1994 |
| EP | 0726433 | A1 | 8/1996 |
| WO | 8907513 | A1 | 8/1989 |
| WO | 03065948 | A1 | 8/2003 |
| WO | 2005122822 | A1 | 12/2005 |
| WO | 2006035363 | A1 | 4/2006 |

* cited by examiner

*Primary Examiner* — Tuan V Nguyen

(57) ABSTRACT

A docking station for a skin treatment device has a cooling member including an evacuator for lowering a pressure inside the cooling member, and a connector for connecting an interior of the cooling member to a sorbent. The sorbent may include a zeolite. Further, a skin treatment device such as an epilator includes a cooling member for containing the cooling agent.

13 Claims, 5 Drawing Sheets

DOCKING STATION FOR A SKIN TREATMENT DEVICE HAVING A COOLING MEMBER

FIELD OF THE INVENTION

The invention relates to a docking station for a skin treatment device having a cooling member for containing a cooling agent.

The invention further relates to a skin treatment device, particularly an epilator, comprising a cooling member for containing a cooling agent.

BACKGROUND OF THE INVENTION

Removal of hair (epilation) from various parts of the body for cosmetic, medical or other purposes is a routine practice. Hair on non-facial skin is usually removed by plucking, and various devices for such hair removal are known in the art.

As plucking of hair can be very painful, EP 0 348 862 A2 proposes an auxiliary skin cooling device for a hair-removing apparatus. The skin cooling device is designed to cool the skin during the removal of hair and thereby achieves an anaesthetizing effect. The described cooling device preferably comprises a heat-accumulating cooling element, such as a small compartment filled with a phase-changing liquid having a large heat capacity. The cooling element needs to be cooled before use, which is typically done by placing the cooling element or the entire hair-removing apparatus in a cold environment, for example, a freezer, and by leaving it there at least until the phase-changing liquid has frozen, or until the cooling element has reached a thermal equilibrium with the cold environment. When brought into contact with the skin, the pre-cooled cooling element absorbs heat, thereby cooling the skin.

However, the necessity of placing the cooling element in a cold environment before use involves a number of drawbacks. Placing the cooling element in a freezer reduces the space available for other items in the freezer. The cooling member must also be food-safe, which prevents a number of otherwise suitable substances from being used as cooling liquid. A major drawback is that the cooling member cannot be refrozen quickly when it defrosts during an extended epilation session. In fact, the cooling member must typically be stored in a freezer for several hours before it has reached a sufficiently low temperature. During a break of the epilation session, the cooling member has to be put back into a cold environment so as to prevent it from defrosting. Finally, a cold environment for cooling the cooling member is not always readily available to the user.

It is an object of the invention to provide means and methods that overcome these drawbacks.

This object is achieved by the features of the independent claims. Further specifications and preferred embodiments of the invention are stated in the dependent claims.

SUMMARY OF THE INVENTION

According to the invention, the docking station comprises: an evacuator for lowering a pressure inside the cooling member of the skin treatment device, and means for connecting an interior of the cooling member for containing the cooling agent to a sorbent. The evacuator is preferably a vacuum pump. By pumping gas out of the cooling member, the pressure inside the cooling member may be lowered below the vapor pressure of the cooling agent inside the cooling member. When the inside of the cooling member is connected to the sorbent, the latter rapidly adsorbs vapor of the cooling agent, thereby causing a further evaporation of the cooling agent and lowering the cooling agent's temperature until it freezes. The cooling principle as such is known from U.S. Pat. No. 5,207,073. As has been pointed out in this document, the pressure of the cooling agent needs to be below the vapor pressure so as to ensure that the cooling agent freezes entirely and not only at its surface. It is therefore advantageous to provide a seal between the cooling member and the sorbent which is removed only when the pressure has reached a sufficiently low value. The vapor pressure is about 5 mbar for water at room temperature and less for aqueous solutions.

The sorbent preferably comprises a water-adsorbing substance. This allows various aqueous solutions to be used as cooling agents.

In accordance with a preferred embodiment, the sorbent comprises a zeolite. This porous mineral is known for its superb adsorption characteristics for water and is readily available. Zeolite cooling is certainly one of the most efficient ways of rapidly freezing small quantities of water. First tests indicate that 480 g of zeolite are saturated after twenty cooling applications, each application using 25 ml of water. The zeolite thus has to be either replaced or regenerated (dried). Regeneration is possible by heating the zeolite, e.g. by placing it in a thermal or microwave oven.

The docking station may comprise a cartridge holder for receiving a replaceable cartridge containing the sorbent. A cartridge containing a saturated quantity of sorbent can thus be replaced by a cartridge containing an unsaturated quantity of sorbent. The cartridge preferably comprises a water-tight housing to prevent the sorbent from adsorbing water while not in use. In accordance with a preferred embodiment, the sorbent can be removed from the cartridge and put back into the cartridge by the user. This enables the user to regenerate the sorbent by placing it in, for example, a kitchen oven or a microwave oven.

The docking station may comprise a heater for drying the sorbent. A saturated quantity of sorbent can thus be regenerated (dried, if the cooling agent is water), using the docking station.

The docking station may comprise means for engaging the skin treatment device. The skin treatment device may thus be firmly kept in an advantageous position relative to the docking station, reducing mechanical strain in the contact area where the cooling member is connected to the sorbent.

The docking station may comprise a contact for charging a battery of the skin treatment device. A battery of the skin treatment device can thus be charged while the device is docked to the docking station.

The docking station may comprise a pressure sensor for sensing the pressure of gas inside the cooling member. The docking station preferably further comprises a control unit for controlling the evacuator as a function of information received from the pressure sensor. The pressure sensor is not essential if the system is tight and remains tight while the epilator is docked to the docking station. However, it may be used advantageously for detecting the presence of a leak in the system, or for regulating the power of the evacuator.

According to the invention, the skin treatment device comprises means for connecting the interior of the cooling member to a docking station as described above. In accordance with a preferred embodiment, the means comprise a duct designed to engage with a complementary duct of the docking station.

In accordance with a preferred embodiment, the cooling agent is water or an aqueous solution. Water is safe, readily available, has a large heat capacity and allows regeneration of the sorbent by heating.

The connecting means are preferably designed to be open when the skin treatment device is coupled to the docking station, and closed otherwise. The cooling agent may thus flow from the cooling member to the docking station only when the skin treatment device is docked to the docking station.

According to the invention, a method of cooling a cooling member of a skin treatment device comprises the steps of:

the skin treatment device engaging with a docking station;

the docking station lowering the pressure inside the cooling member; and the docking station establishing a connection from the interior of the cooling member to a sorbent.

The docking station preferably lowers the pressure inside the cooling member by pumping out vapor. The docking station preferably establishes the connection between the interior of the cooling member and the sorbent when the pressure in the cooling member has dropped below a predetermined value, preferably below the vapor pressure of the agent.

The method may further comprise a step of heating the sorbent.

In accordance with a preferred embodiment, the method may further comprise a step of inserting a cartridge containing the sorbent into a cartridge holder of the docking station.

The method may further comprise a step of detaching the skin treatment device from the docking station. The skin treatment device can thus be separated completely from the docking station for ease of handling during a skin treatment session.

It is to be noted that the invention may be employed advantageously for various types of skin treatment for which a pain-reducing cooling effect is desired, including epilation, skin surgery, tattooing, and wellness applications.

These and other aspects of the invention are apparent from and will be elucidated with reference to the embodiments described hereinafter.

DESCRIPTION OF EMBODIMENTS

Figure 1:
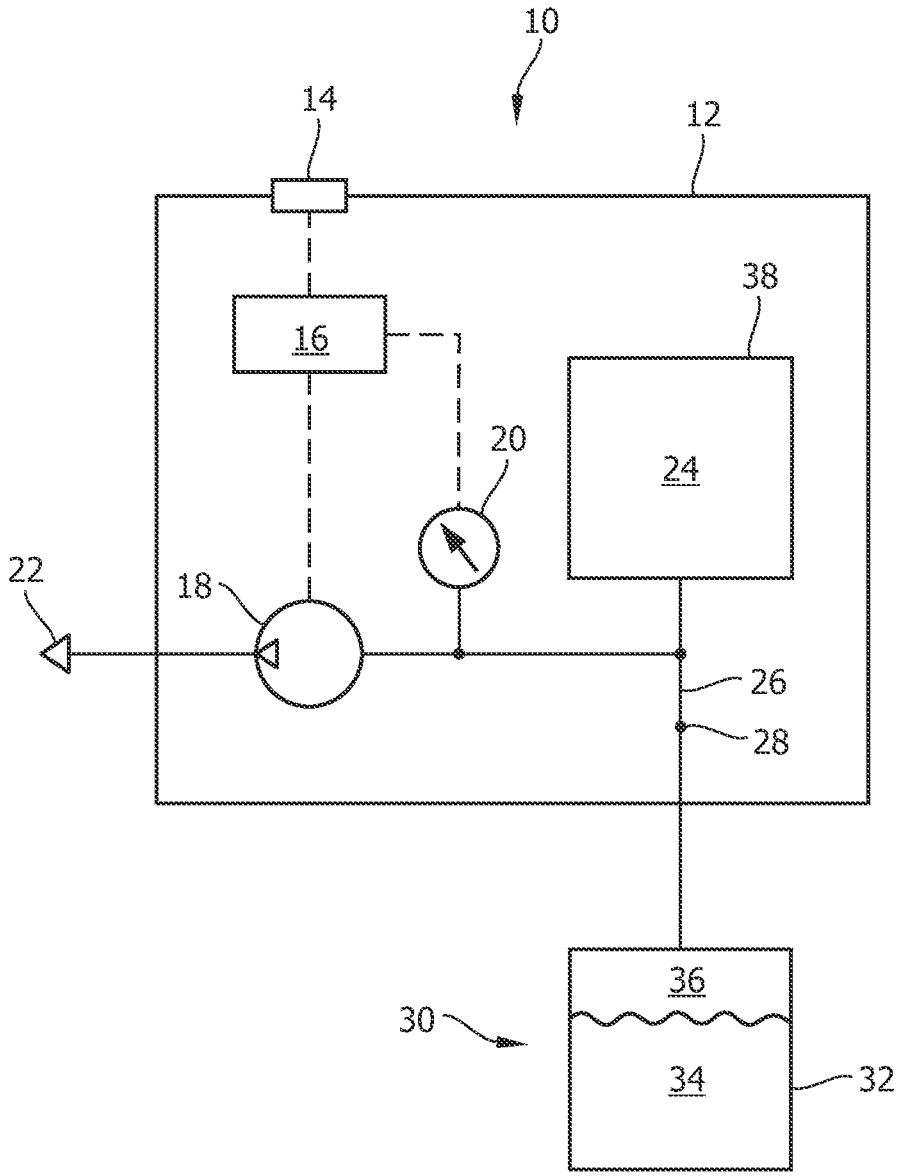
FIG. 1 is a schematic view of a docking station and a skin treatment device according to the invention.

Similar or analogous features appearing in different Figures are designated by the same reference numerals and are not necessarily described more than once.

FIG. 1 shows diagrammatically a docking station 10 comprising a housing 12, a sorbent 24, a duct 26, a vacuum pump 18, an outlet 22, a controller 16, a button 14 referred to as the "ice" button, and a pressure sensor 20. The sorbent 24 has an airtight protective seal cladding 38. The sorbent preferably consists of zeolite, but any other suitable water-adsorbing material may be used instead. Removably attached (docked) to the docking station is an epilator 30 comprising a cooling member 32 containing water or an aqueous solution 34, and possibly a certain quantity of vapor 36 or air. A portion of the outer surface of the cooling member 32 provides a skin contact surface 44 (not shown here but in FIG. 4). The interior of the cooling member 32, i.e. the volume containing the water 34 and the vapor (or air) 36, is connected at a docking point 28 via the duct 26 to the docking station 10. The interior of the cooling member 32 and the sorbent 24 thus communicate. The docking point 28 is designed in such a way that it effectively seals the duct 26 when the epilator 30 is removed (undocked) from the docking station 10 so as to prevent water from leaking out. This can be realized, for example, by means of a valve or a spring that automatically seals the duct 26 when the epilator is undocked. Similarly, the cooling member 32 is automatically sealed when undocked. The pump 18 is arranged between the duct 26 and the outlet 22. The pressure sensor 20 measures the pressure in the duct 26 and transmits the measured values to the controller 16. When a user presses the ice button 14, the controller 16 triggers the pump 18 to pump gas out of the cooling member 32 (and possibly out of the sorbent 24), thereby reducing the pressure within the cooling member 32. When the pressure drops below a certain critical value, typically about 5 mbar, the sorbent 24 starts adsorbing the water vapor 36 at a significant rate, causing more water 34 to evaporate and lowering the temperature of the water 34 until it freezes. The evaporation transfers thermal energy initially contained in the water 34 to the water vapor 32 which is adsorbed by the sorbent 24, causing the latter to heat up. When the water 34 has frozen, no further significant quantity of water 34 evaporates, although some water molecules may still sublimate. The cooling then stops automatically. The pump preferably operates until the cooling stops because the vapor pressure to be attained decreases as the temperature decreases. Pumping until the cooling stops is also advantageous if the system is imperfectly sealed. It is noted that the Figure only shows some essential elements. The docking station may comprise additional elements for improving its efficiency. It may be particularly envisaged to arrange an additional pneumatic element, e.g. an electro-pneumatic valve, between the sorbent 24 and the duct 26 and to couple the additional pneumatic element to the controller 16 so as to prevent vapor 36 from being adsorbed by the sorbent 24 as long as the pressure measured by the pressure sensor 20 exceeds the vapor pressure of the water 34.

In the embodiment described above with reference to FIG. 1, the vacuum pump 18 is arranged parallel to the sorbent 24. In accordance with an alternative embodiment (not shown), the pump 18 and the sorbent 24 are arranged in series so that the pump 18 is capable of pumping vapor 36 from the cooling member 32 through the sorbent 24. Whereas arranging the pump 18 and the sorbent 24 in series may shorten the lifetime of the sorbent 24, it may increase the freezing power and the reliability of the system 10, 30. The pump may either precede or succeed the sorbent with respect to the flow direction of the vapor during the pumping process. The pump 18 preferably succeeds the sorbent 24 so that, during use, vapor first flows through the sorbent 24 and then through the pump 18.

Figure 2:
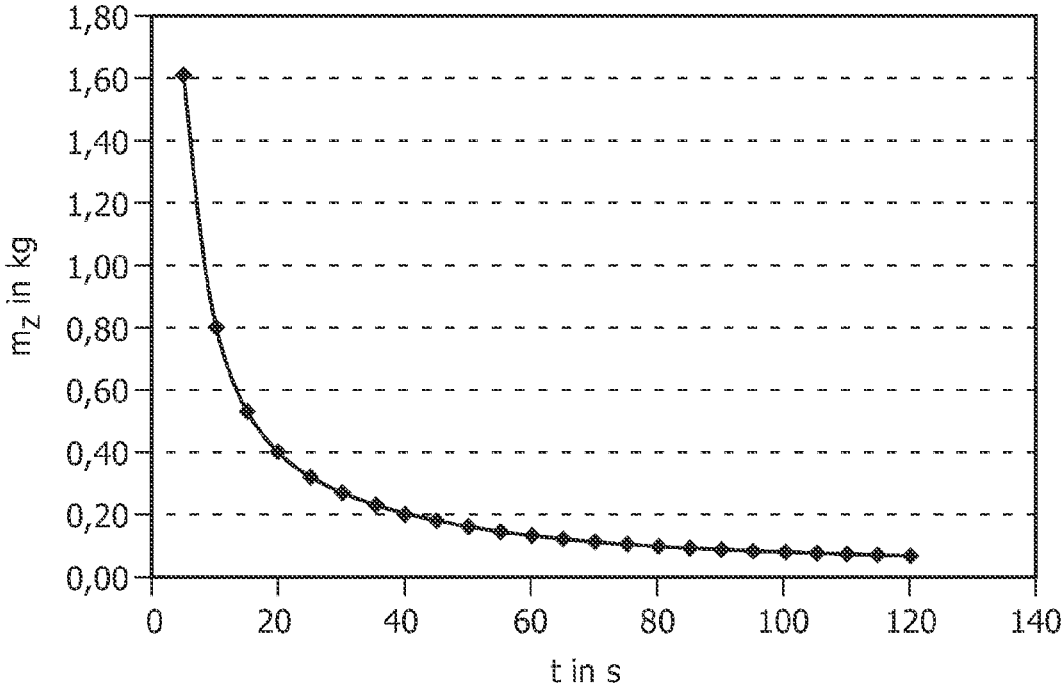
FIG. 2 is a plot of the quantity of zeolite required for cooling 25 ml of water from 30° C. down to 0° C. as a function of the duration of the cooling process.

FIG. 2 shows the estimated quantity of zeolite required for cooling 25 ml of water from 30° C. down to 0° C. as a function of the duration of the cooling process. Preliminary calculations predict that 25 ml of water may be cooled down from 30° C. to 0° C. within 45 seconds by using about 180 grams of zeolite.

Figure 3:
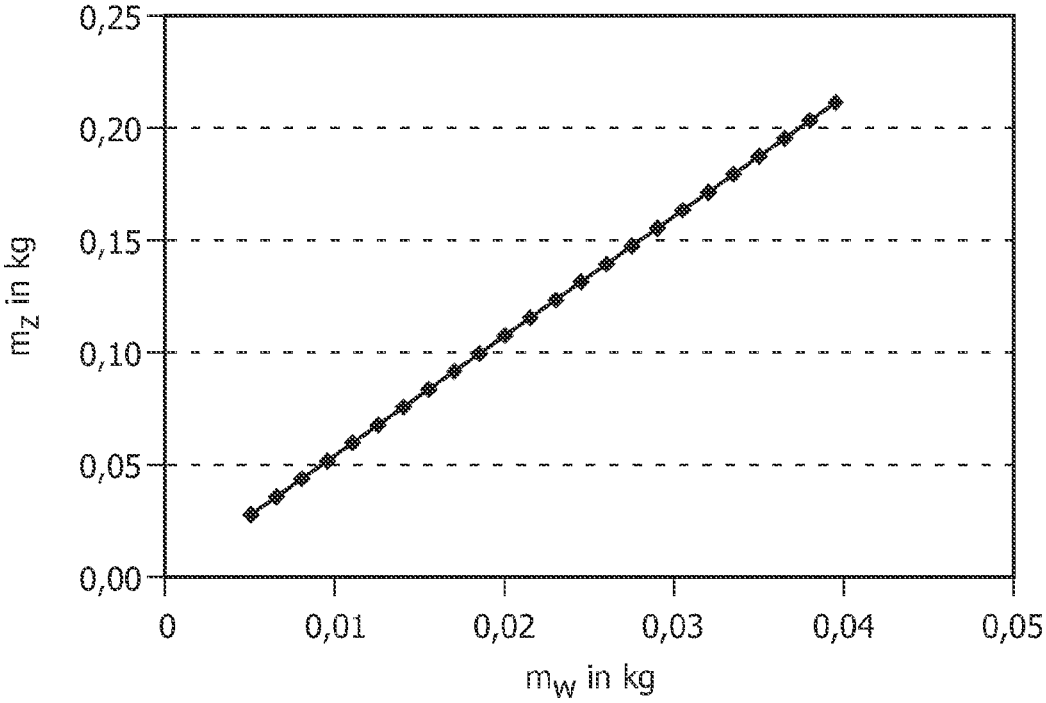
FIG. 3 is a plot of the quantity of zeolite required for cooling water from 30° C. down to 0° C. within 60 seconds as a function of the quantity of water that is cooled.

Plotted in FIG. 3 is the quantity of zeolite required for cooling water from 30° C. down to 0° C. within 60 seconds, as a function of the quantity of water that is cooled.

Figure 4:
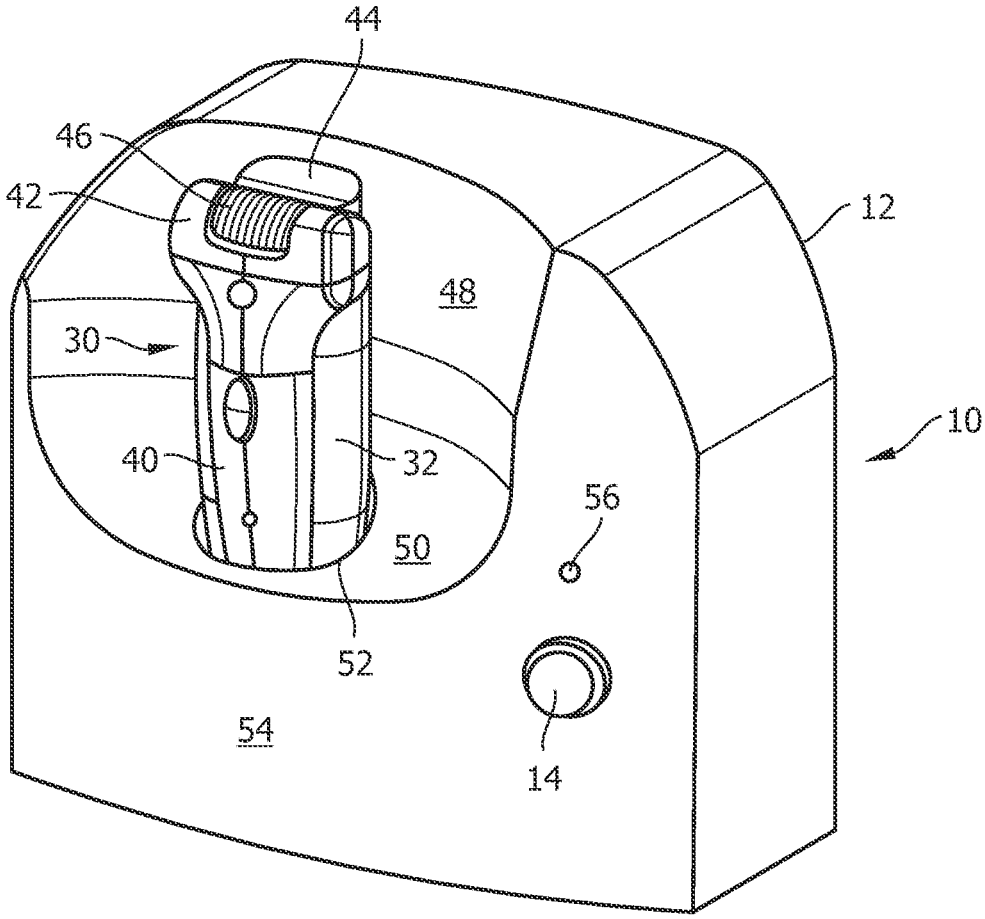
FIG. 4 is an oblique view of a docking station according to the invention, with an epilator docked to the docking station.

FIG. 4 shows a docking station 10 with an epilator 30 docked to it. The epilator 30 comprises a handpiece 40, an epilating member 46 comprising clamping discs surrounded by a cap 42, and a cooling member (ice accu) 32 having a skin contact surface 44. The docking station comprises a housing 12 having a generally cuboidal shape. A front portion 54 and a top portion of the housing define a concave portion 48, 50 for receiving the epilator 32. The concave portion 48, 50 is dimensioned in such a way that the epilator can be easily attached to and removed from the docking station 10. The concave portion is composed of a generally horizontal lower concave portion 50 and a generally vertical upper concave portion 48. The lower concave portion 52 has an oval opening 52 forming an entrance to a cavity having a cross-section that is slightly larger than a cross-section of the handpiece 40 of the epilator 30 so that a lower portion (not visible in the Figure) of the handpiece 40 fits into the opening 52, such that the epilator 32 is secured to the housing 12. The epilator 30 is thus docked to the docking station 10 in an upright position, with about two thirds of the outer surface of the handpiece 40 being freely accessible by a user, allowing easy docking and undocking. Also arranged on the front portion 54 of the housing 12 is the ice button 14, described with reference to FIG. 1, and an indicator lamp 56 comprising a green and a red light-emitting diode (LED). The indicator lamp 56 is controlled by the controller 16 described with reference to FIG. 1. While the freezing is in process, the indicator lamp 56 emits red light. When the freezing process has stopped, the indicator lamp 56 emits green light, thereby indicating to the user that the cooling member 32 of the epilator 30 is operational.

Figure 5:
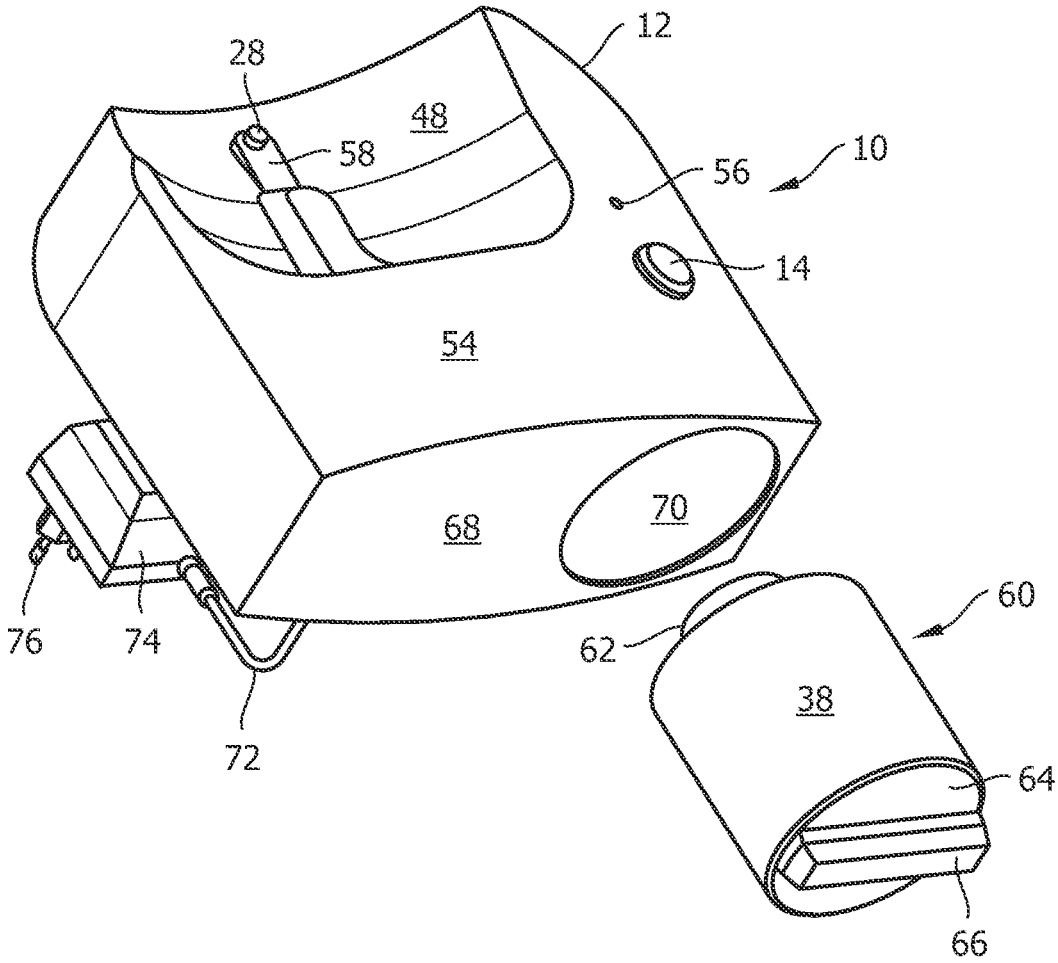
FIG. 5 is a view from a different perspective of the docking station shown in FIG. 4.

FIG. 5 shows the docking station 10 viewed from below at an oblique angle, with the epilator 30 of FIG. 4 undocked. The epilator 30 is therefore not visible in the Figure. With the epilator 30 now being separated from the docking station 10, it can be seen that the upper concave portion 48 is provided with a docking point 28 and a spring leaf 58 for ensuring a firm and watertight connection between the cooling member of the epilator and the sorbent 24 (see FIG. 1) contained in the docking station 10. A generally rectangular bottom plate 68 of the docking station 10 has a circular opening 70 forming an entrance to a cylindrical cavity within the docking station 10 for receiving a cylindrical cartridge 60. The cartridge 60 has a watertight cartridge housing 38 containing a sorbent 24 (see FIG. 1) consisting of zeolite. On a first of its two circular front sides, the cylindrical cartridge 60 is provided with a docking element 62 comprising a closeable inlet for receiving water vapor from the cooling member 32 when the latter is docked to the docking station as shown in FIG. 4. On the second of its two circular front sides, the cylindrical cartridge is sealed by a circular front plate 64 which is traversed by a grip 66 for facilitating insertion and removal of the cartridge 60 into and from the docking station 10 by turning the cartridge 60 around its axis of symmetry. When one zeolite cartridge is used, it is possible to freeze the cooling member approximately twenty times. The docking station 12 further comprises an electric power converter 74 having a plug 76 for plugging the power converter to a power socket. When plugged to a power socket, the power converter provides power for the docking station 10 itself, in particular for the pump 18 used for evacuating the cooling member, as well as for charging a battery of the epilator when the latter is docked to the docking station. To this end, the docking station is equipped with an electric contact for contacting a complementary contact of the epilator. The electric contact is preferably arranged at the bottom of the cavity situated below the opening 52 described with reference to FIG. 3.

Figure 6:
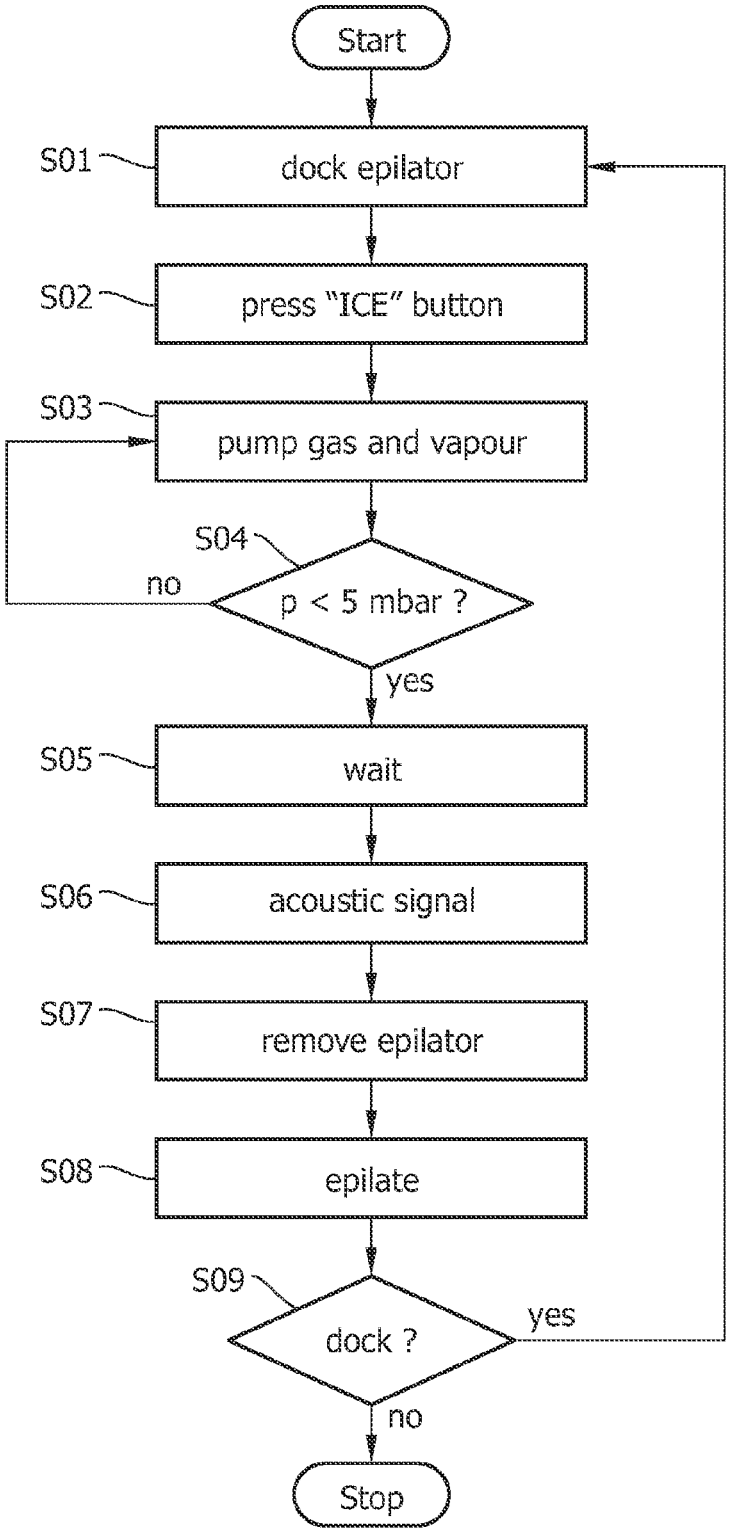
FIG. 6 is a flow chart of a method according to the invention.

FIG. 6 is a flow chart of a method according to the invention. In a first step S01, an epilator is docked to a docking station. By pressing an "ice" button on the docking station (step S02), a user actuates a vacuum pump within the docking station. The pump consequently starts evacuating a cooling member of the epilator (step S03), while a pressure sensor measures the gas pressure inside the cooling member. In step S04, it is determined whether the measured pressure is below 5 mbar. If the pressure is found to be above 5 mbar, the method returns to step S03 (the pump continues pumping); otherwise the pump is shut down. In step S05, a certain period of time, of the order of a few seconds to a few minutes, is left to elapse during which a sorbent situated inside the docking station adsorbs water vapor released from the cooling member of the epilator, thereby lowering the temperature of the water remaining in the cooling member. When the water in the cooling member has frozen, the docking station emits an acoustic or optical signal (step S06), thereby informing the user that the cooling member has reached its operating temperature. The user then separates the epilator from the docking station (step S07) and starts an epilation session (step S08). In accordance with a preferred embodiment, the cooling member remains frozen for about twenty minutes. When the epilation session has been terminated, the user decides whether or not to re-dock the epilator to the station (step S09). If the user decides to re-dock the epilator, the method returns to step S01; otherwise the method is terminated. It is noted that the method may further comprise a step of replacing a cartridge containing sorbent. Alternatively, the method may further comprise a step of drying the sorbent, particularly by heating it, either by using a heater provided in the docking station or by placing it into an oven or a microwave heater. The method preferably further comprises a step of charging a battery of the epilator.

While the invention has been illustrated and described in detail in the drawings and in the foregoing description, these drawings and description are to be considered as examples and are not restrictive. The invention is not limited to the disclosed embodiments.

Use of the verb "comprise" and its conjugations does not exclude the presence of steps or elements other than those stated in the claims. Use of the indefinite article "a" or "an" preceding an element or step does not exclude the presence of a plurality of such elements or steps. It is also noted that a single unit may provide the functions of several means mentioned in the claims. The mere fact that certain features are recited in mutually different dependent claims does not indicate that a combination of these features cannot be used to advantage. Any reference signs in the claims shall not be construed as limiting their scope.

The invention claimed is:

1. A skin treatment system including a skin treatment device and a docking station the skin treatment device having a cooling member for containing a cooling agent, the docking station comprising:

a sorbent;

an evacuator for lowering a pressure inside the cooling member of the skin treatment device; and a connection device configured to connect an interior of the cooling member to the sorbent, wherein the evacuator is connected to a duct connecting the cooling member to the sorbent, wherein the connection device is further configured to be opened when the skin treatment device is coupled to the docking station, and dosed otherwise, and wherein, when the connection device is opened, the evacuator is actuated to cool the cooling agent.

2. The treatment system of claim 1, wherein the sorbent comprises a water-adsorbing material.

3. The skin treatment system of claim 1, wherein the sorbent comprises a zeolite.

4. The skin treatment system of claim 1, wherein the docking station further comprises a cartridge holder for receiving a replaceable cartridge containing the sorbent.

5. The skin treatment system of claim 1, wherein the docking station further comprises a heater for drying the sorbent.

6. The skin treatment system of claim 1, wherein the docking station further comprises a holder configured to engage the skin treatment device.

7. The skin treatment system of claim 1, wherein the docking station further comprises a contact for charging a battery of the skin treatment device.

8. The skin treatment system of claim 1, wherein the docking station further comprises a pressure sensor for sensing the pressure inside the cooling member.

9. The skin treatment system of claim 1, wherein the evacuator is connected in parallel with the sorbent.

10. The skin treatment system of claim 1, wherein the evacuator is connected in series with the sorbent.

11. The skin treatment system of claim 1, wherein the docking station further comprises an indicator lamp that emits light having a first color while cooling is in process, and emits a second color when the cooling has stopped, wherein the first color is different from the second color.

12. The skin treatment system of claim 11, wherein the first color is red and the second color is green.

13. The skin treatment system of claim 1, wherein the docking station further includes a pressure sensor for measuring the pressure inside the cooling member, wherein the evacuator is configured to shut down if the pressure is below a threshold pressure.

* * * * *